US011713165B2

(12) United States Patent
Askins Gearhart

(10) Patent No.: US 11,713,165 B2
(45) Date of Patent: Aug. 1, 2023

(54) DECORATIVE SLEEVE FOR SOFT-PACKAGING PRODUCTS

(71) Applicant: Amber Askins Gearhart, Ponte Vedra, FL (US)

(72) Inventor: Amber Askins Gearhart, Ponte Vedra, FL (US)

( * ) Notice: Subject to any disclaimer, the term of this patent is extended or adjusted under 35 U.S.C. 154(b) by 630 days.

(21) Appl. No.: 15/813,085

(22) Filed: Nov. 14, 2017

(65) Prior Publication Data

US 2018/0134456 A1 May 17, 2018

Related U.S. Application Data

(60) Provisional application No. 62/421,885, filed on Nov. 14, 2016.

(51) Int. Cl.

| | |
|---|---|
| ***B65D 35/28*** | (2006.01) |
| ***B65D 81/24*** | (2006.01) |
| ***B65D 35/44*** | (2006.01) |
| ***B65D 35/14*** | (2006.01) |
| ***B65D 23/08*** | (2006.01) |

(Continued)

(52) U.S. Cl.

CPC ..... *B65D 35/28* (2013.01); *B65D 23/0842* (2013.01); *B65D 35/14* (2013.01); *B65D 35/42* (2013.01); *B65D 35/44* (2013.01); *B65D 35/56* (2013.01); *B65D 81/24* (2013.01)

(58) Field of Classification Search

CPC .... B65D 35/28; B65D 23/0842; B65D 35/14; B65D 81/24; B65D 35/44; B65D 2205/02; B65D 2205/00; B65D 81/3876; B65D 23/106; B65D 23/0871; A45F 5/00; A45F 3/16; A45F 2005/006; A45F 2200/0583; A45F 2005/002; A45C 1/08; A45C 11/34; A45C 2200/10; A45C 15/04; A45C 2013/306; G09F 2003/027; G09F 2003/025

USPC ..... 206/457, 459.1, 807, 277; 222/131, 183, 222/105; 220/256.1; 405/45

See application file for complete search history.

(56) References Cited

U.S. PATENT DOCUMENTS 2,076,048 A * 4/1937 Seelman ..... B65D 35/28 222/103
2,084,273 A * 6/1937 Beach ..... B65D 35/02 222/105

(Continued)

OTHER PUBLICATIONS https://www.mentalfloss.com/article/649033/classic-blind-taste-test-commercials (Year: 1978).*

*Primary Examiner* — Mollie Impink

(74) *Attorney, Agent, or Firm* — Camille A. Wilson; Wilson Dutra, PLLC

(57) ABSTRACT

The present disclosure provides generally for transforming the exterior of everyday products, such as toiletries and makeup, to have a decorative aesthetic. More specifically, the present disclosure describes a decorative sleeve for soft-packaging products, such as toothpaste, tubes of makeup, or lotion containers. In some aspects, the decorative sleeve may be universal, wherein the decorative sleeve may be adaptable to a range of soft-packaging products. In some embodiments, the decorative sleeve may be customizable, wherein a user may customize one or more parameters of the decorative sleeve, such as size, color, functionality, or text, as non-limiting examples.

13 Claims, 6 Drawing Sheets

(51) Int. Cl.
*B65D 35/42* (2006.01)
*B65D 35/56* (2006.01)

(56) References Cited

U.S. PATENT DOCUMENTS 2,564,359 A * 8/1951 Fuller ..... B65D 35/28 222/206
2,638,250 A * 5/1953 Houldsworth ..... B65D 35/28 222/103
3,178,060 A 4/1965 Bossack
3,269,604 A * 8/1966 Serry ..... B65D 35/24 222/105
3,628,696 A * 12/1971 Duiker ..... B65D 35/32 222/99
3,680,726 A * 8/1972 Massey ..... B44C 1/18 215/12.2
3,760,968 A * 9/1973 Amberg ..... B29C 63/426 215/12.2
4,020,978 A * 5/1977 Szczepanski ..... B65D 35/28 222/209
4,753,006 A * 6/1988 Howe ..... B26B 21/446 222/105
5,454,483 A * 10/1995 Ichikawa ..... A47G 23/0258 220/737
5,673,880 A * 10/1997 Dexter, Jr. ..... B65D 35/56 248/101
5,890,625 A * 4/1999 de Laforcade ..... B65D 35/28 222/103
6,033,392 A * 3/2000 Frey ..... A61J 1/16 206/365
6,135,322 A * 10/2000 Cetrangolo ..... C04B 35/581 206/466
7,661,559 B1 * 2/2010 Tresenfeld ..... A47B 81/00 222/93
8,579,133 B2 11/2013 Marcus et al.
9,198,504 B2 * 12/2015 McCoy ..... A46B 11/0089
9,498,406 B2 * 11/2016 Donschietz ..... A61J 1/16
9,815,610 B2 * 11/2017 Yamada ..... B65D 47/20
10,262,559 B2 * 4/2019 Hinch ..... G09F 1/065
2002/0108971 A1 * 8/2002 Lafond ..... B05C 17/0116 222/333
2007/0007303 A1 1/2007 Esch
2007/0068944 A1 * 3/2007 McKinney ..... A45F 5/00 220/256.1
2007/0187430 A1 * 8/2007 Chen ..... B65D 35/14 222/105
2008/0179339 A1 * 7/2008 Lafaver ..... B65D 23/0871 220/694
2008/0194171 A1 8/2008 Ritter
2011/0154626 A1 * 6/2011 VanDenBogart ..... A61G 17/08 27/1
2012/0187160 A1 * 7/2012 Wolf ..... A45C 11/00 66/8
2013/0039604 A1 * 2/2013 Scutaro ..... B65D 77/0406 383/33
2013/0126571 A1 * 5/2013 Field ..... A45B 25/26 224/613
2014/0069888 A1 * 3/2014 Warden ..... A61J 9/08 215/386
2014/0116463 A1 5/2014 Edelstein et al.
2015/0145208 A1 * 5/2015 Moriak ..... A63F 1/00 273/292
2016/0022073 A1 * 1/2016 Mangum ..... A47G 23/0216 206/457
2016/0213181 A1 * 7/2016 Gonzalez, II ..... B65D 23/0842
2017/0349334 A1 12/2017 Kleyman et al.

* cited by examiner

FIG. 4A
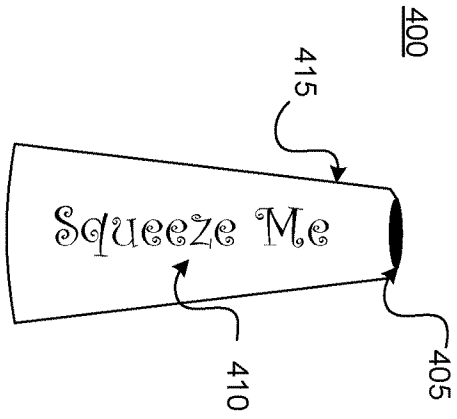
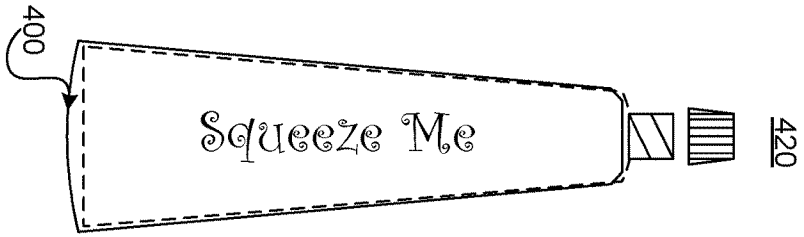
FIG. 4B
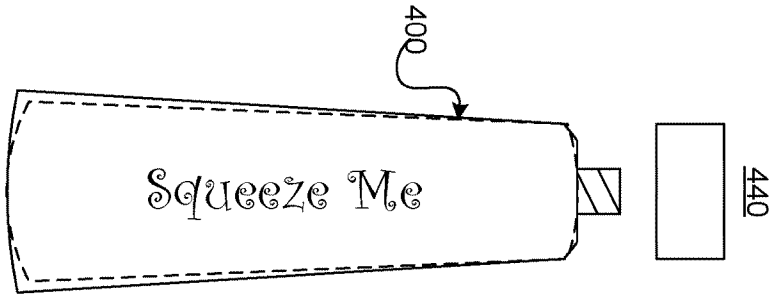
FIG. 4C
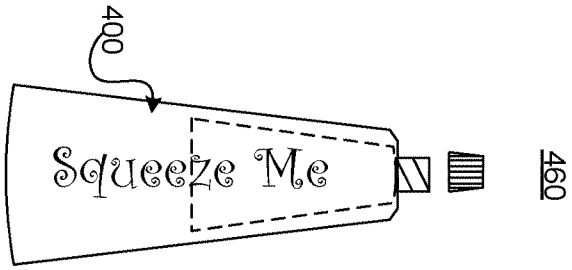
FIG. 4D
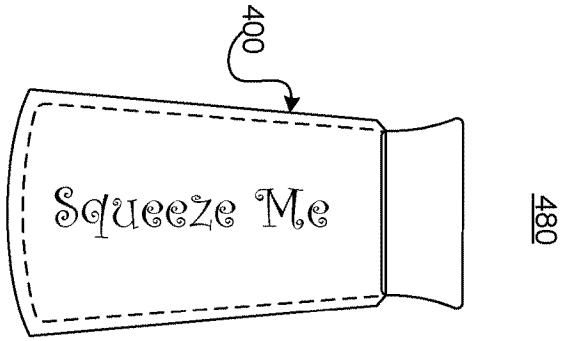
FIG. 4E

DECORATIVE SLEEVE FOR SOFT-PACKAGING PRODUCTS

CROSS-REFERENCE TO RELATED APPLICATION

This application claims priority to and the full benefit of U.S. Provisional Patent Application Ser. No. 62/421,885, filed Nov. 14, 2016, and titled "DECORATIVE SLEEVE FOR SOFT-PACKAGING PRODUCTS", the entire contents of which are incorporated in this application by reference.

BACKGROUND OF THE DISCLOSURE

A variety of styles may be found in someone's home, ranging from contemporary to modern, designs featuring angular lines and flowing curves, to those evoking more traditional styles such as Victorian or colonial. Aesthetic and decorative choices are abundant, and these options lead to decisions about what colors to showcase or highlight in rooms, including whether to incorporate decorative elements like curtains, linens, or wallpaper, or whether to have artwork that accentuates or highlights each individual room by stressing uniformity or individuality.

One particular room that receives such careful consideration in a home is a bathroom. There are limitless considerations for a bathroom space, such as those previously mentioned, or considering whether to feature or incorporate marble, tile, wood, or other materials throughout the room. In fact, the bathroom receives particular attention due to the organizational needs for everyday items used there. For example, there are ornamental or decorative tissue boxes to bring uniformity to a surrounding area. The same treatment extends to soap dispensers, towels, and dental hygiene products.

Sometimes these items enhance the utility of the bathroom, or make it so that someone does not have to constantly worry about whether daily items fit in to the aesthetic of whatever bathroom is being used. However, there are situations where it may be inconvenient or unsanitary to store an item in a cabinet or into another container, such as makeup in a bag or toothpaste into ajar near the sink.

SUMMARY OF THE DISCLOSURE

What is needed, therefore, is a customizable decorative covering, slip, or sleeve that may be fitted to everyday products, particularly products with soft-packaging, such as toothpaste, makeup, or lotion containers, while also being hygienic. This decorative sleeve may incorporate various modalities for ease of use by the user, such as a squeeze toggle for ease of access to and efficient use of the product itself, textured surface for ease of use or discovery, or coverings for convenience and ease of transport.

Having a decorative sleeve may allow someone to decorate their bathroom without worrying that an everyday product left out, intentionally or unintentionally, may distract from the aesthetic of the room. A decorative sleeve may promote use of some products, as it may be more conveniently accessed, be more difficult to overlook, and encourage direct use.

Accordingly, the present disclosure provides generally for transforming the exterior of everyday products, such as toiletries, medicine, ointments, makeup, or similar products with soft packaging to have a decorative aesthetic. More specifically, the present disclosure describes a decorative sleeve for soft-packaging products, such as toothpaste, tubes of makeup, ointments, or lotion containers, or for visible products requiring some privacy feature. In some aspects, the decorative sleeve may be universal, wherein the decorative sleeve may be adaptable to a range of soft-packaging products. In some embodiments, the decorative sleeve may be customizable, wherein a user may customize one or more parameters of the decorative sleeve, such as size, color, functionality, or text, as non-limiting examples.

The present disclosure relates to a decorative sleeve for soft-packaging products, which may comprise a body; a dispensing opening; and a product configured to be dispensed through the dispensing opening. In some aspects, the decorative sleeve may comprise a receiving opening configured to receive a portion of the soft-packaging product; a sheath configured to conceal at least the body when the receiving portion has received the portion of the soft-packaging product, where the receiving portion is located at a first end of the sheath; and a decorative feature located on the sheath.

In some implementations, the first end may be located at a side of the sheath. In some embodiments, at least a portion of the decorative feature may include text. In some aspects, the decorative sleeve may comprise a fitting mechanism configured to secure a position of the soft-packaging product within the sheath. In some implementations, the sheath may comprise one or more holes. In some embodiments, the decorative feature may be integrated into a material of the sheath. In some aspects, the sheath may comprise an antimicrobial material. In some implementations, the first end may be located at a distal end of the sheath. In some embodiments, the receiving opening may be configured to extend over an edge of the soft-packaging product.

In some aspects, the decorative sleeve may comprise a connector and a cap configured to fit over the dispensing opening, where the cap may be attached to the connector and the connector may be attached to the first distal end. In some embodiments, the sheath may comprise a stretchable material. In some implementations, the sheath may comprise a textured surface. In some aspects, the decorative feature may create the textured surface.

In some embodiments, the sheath may comprise a metallic material. In some implementations, the sheath may comprise a plurality of foldable edges. In some aspects, the decorative sleeve may comprise a washable material. In some embodiments, at least a portion of the decorative sleeve may comprise a silicone. In some aspects, the decorative sleeve may comprise a squeeze toggle configured to fit over the body, where the squeeze toggle may be configured to allow a user to efficiently dispense the product. In some embodiments, the squeeze toggle may be integrated into the sheath. In some implementations, the squeeze toggle may be separate from the sheath and may extend through the sheath.

BRIEF DESCRIPTION OF THE DRAWINGS

The accompanying drawings, that are incorporated in and constitute a part of this specification, illustrate several embodiments of the disclosure and, together with the description, serve to explain the principles of the disclosure:

FIG. 4A illustrates an exemplary decorative sleeve, wherein the exemplary decorative sleeve comprises a stretchable material.

FIG. 4B illustrates an exemplary embodiment of a soft-packaging product with a decorative sleeve wherein the exemplary decorative sleeve comprises a stretchable material.

FIG. 4C illustrates an exemplary embodiment of an alternate soft-packaging product with a decorative sleeve wherein the exemplary decorative sleeve comprises a stretchable material.

FIG. 4D illustrates an exemplary embodiment of an alternate soft-packaging product with a decorative sleeve wherein the exemplary decorative sleeve comprises a stretchable material.

FIG. 4E illustrates an exemplary embodiment of an alternate soft-packaging product with a decorative sleeve wherein the exemplary decorative sleeve comprises a stretchable material.

DETAILED DESCRIPTION

The present disclosure provides generally for transforming the exterior of everyday products, such as toiletries and makeup, to have a decorative aesthetic. More specifically, the present disclosure describes a decorative sleeve for soft-packaging products, such as toothpaste, tubes of makeup, or lotion containers. In some aspects, the decorative sleeve may be universal, wherein the decorative sleeve may be adaptable to a range of soft-packaging products. In some embodiments, the decorative sleeve may be customizable, wherein a user may customize one or more parameters of the decorative sleeve, such as size, color, functionality, or text, as non-limiting examples.

In the following sections, detailed descriptions of examples and methods of the disclosure will be given. The description of both preferred and alternative examples, though thorough, are exemplary only, and it is understood to those skilled in the art that variations, modifications, and alterations may be apparent. It is therefore to be understood that the examples do not limit the broadness of the aspects of the underlying disclosure as defined by the claims.

Glossary

Decorative sleeve: as used herein refers to a fitted decorative covering for soft-packaging products, wherein the covering at least partially obscures the exterior of the soft-packaging product. In some aspects, the decorative aspect of the decorative sleeve may comprise colors, shapes, text, glitter, images, and/or extensions.

Soft-packaging product: as used herein refers to a product enclosed by a packaging that may change shape as the amount of the enclosed product changes, wherein the product comprises a liquid or semi-solid, such as a paste, lotion, cream, gels, or salve, as non-limiting examples.

Figures 1A, 1B, 1C:
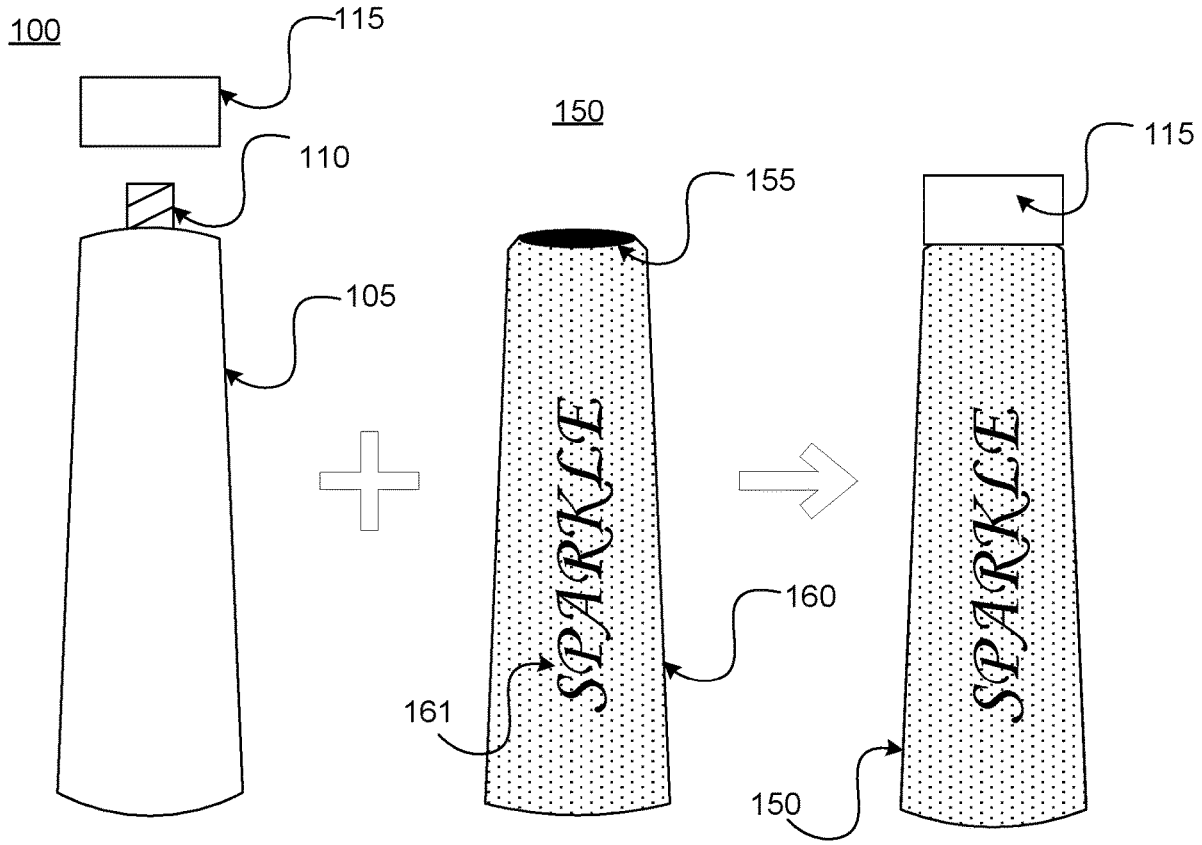
FIG. 1A illustrates an exemplary soft-packaging product.
FIG. 1B illustrates an exemplary decorative sleeve.
FIG. 1C illustrates an exemplary embodiment of a soft-packaging product with a decorative sleeve.

Referring now to FIG. 1A, an exemplary soft-packaging product 100 is illustrated. In some aspects, a soft-packaging product 100 may comprise a body 105, a threaded dispensing opening 110, and a removable cap 115, wherein removal of the removable cap 115 may expose the threaded dispensing opening 110. For example, the soft-packaging product 100 may comprise toothpaste, wound ointment, or muscle cream.

Referring now to FIG. 1B, an exemplary decorative sleeve 150 is illustrated, wherein the decorative sleeve 150 is configured to fit over a soft-packaging product. In some embodiments, the decorative sleeve 150 may comprise a sheath 160 with at least one decorative feature 161 and a receiving opening 155, wherein a soft-packaging product may be inserted into the receiving opening 155. In some aspects, the sheath 160 may comprise a pliable material, such as a material that may allow for a user to squeeze the soft-packaging product through the sheath 160, which may reduce the need to remove the sheath 160 for each use.

In some aspects, the sheath 160 may be opaque and the decorative feature 161 may comprise a color with or without text. In some embodiments, the text may complement the color or appearance of the sheath 160. For example, the sheath 160 may be black with glitter, and the text may read "SPARKLE," which may be appropriate where the soft-packaging product comprises toothpaste or iridescent lotion. In some aspects, the decorative sleeve 150 may be reversible, wherein a user may have two decorative feature 161 options. For example, one side may be bright with the word "Vacation" for traveling, and the other side may say "Home" and complement the bathroom decor in the user's home.

Referring now to FIG. 1C, an exemplary embodiment of a soft-packaging product with a decorative sleeve 150 is illustrated. In some aspects, the decorative sleeve 150 may extend over an edge of the body of the soft-product packaging, wherein the removable cap 115 may close over the decorative sleeve 150 when screwed onto the threaded dispensing opening. In some aspects, the sheath may not extend over the edges of the body of the soft-product packaging. In some implementations, the sheath may be reinforced around areas that may need more support, such as around the receiving opening, along the edges, along the center, or at the closed end, as non-limiting examples. In some aspects, the reinforcement may comprise additional material, which may be the same as the surrounding sheath or a different material, for example one that may be more rigid.

Figures 7A, 7B, 7C, 7D:
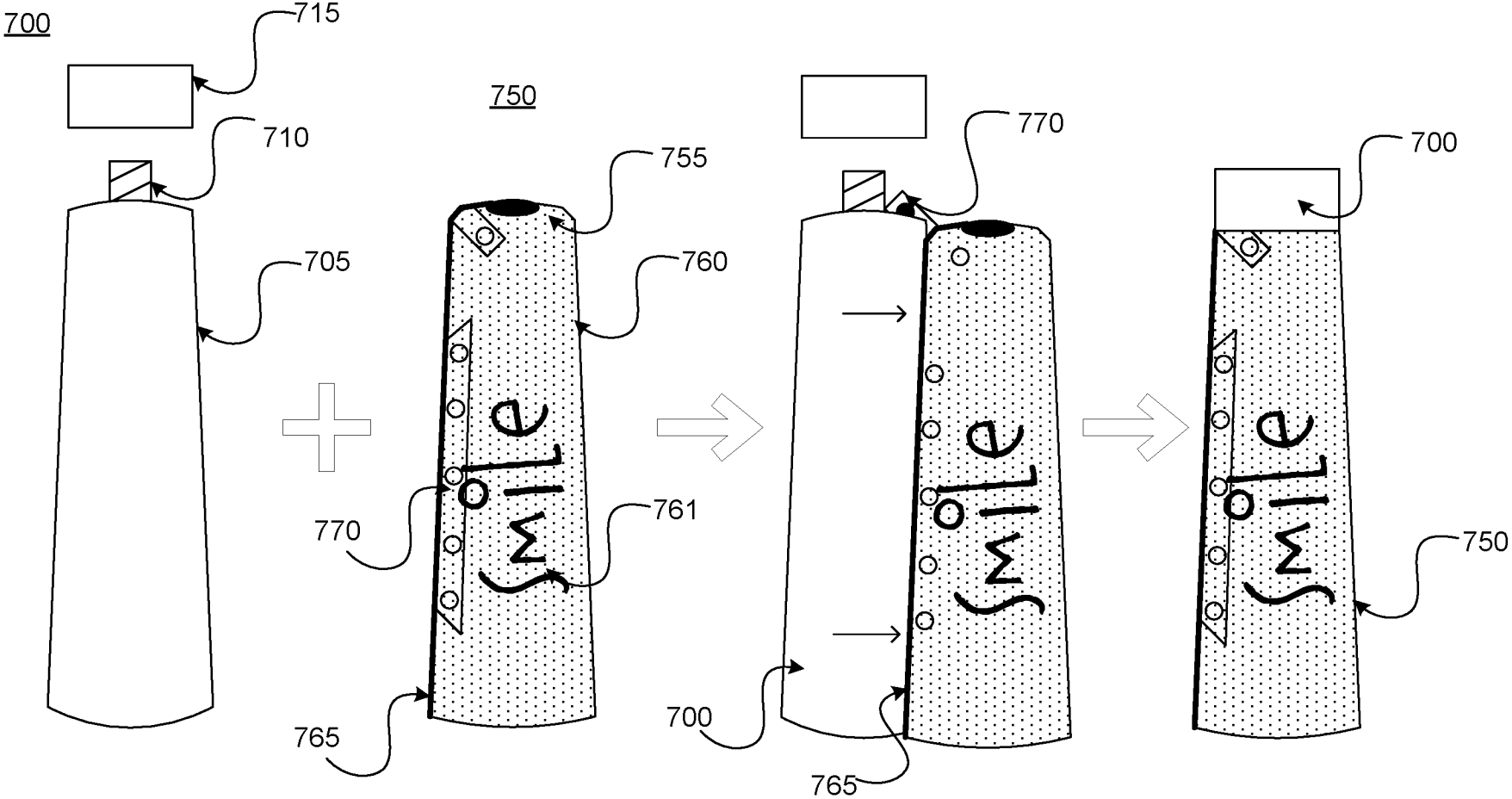
FIG. 7A illustrates an exemplary soft-packaging product.
FIG. 7B illustrates an exemplary decorative sleeve.
FIG. 7C illustrates an exemplary embodiment of a soft-packaging product being inserted into a decorative sleeve.
FIG. 7D illustrates an exemplary embodiment of a soft-packaging product with a decorative sleeve.

In some embodiments (not shown), a fitting mechanism may allow for a tighter fit that may limit movement within the decorative sleeve 150. For example, a snap, button, zipper, or hook may engage along one side, along the back, or over the top of the decorative sleeve 150, such as illustrated in FIG. 7B. In some aspects, the decorative sleeve 150 may maintain its shape even as product is used from the soft-packaging product, which may allow for a clean look throughout the life of the soft-packaging product. In some embodiments, the shape of the decorative sleeve 150 may change over use, such as partially collapsing as product is used. The change of shape may remain clean and aesthetically pleasing. In some implementations, the change of shape may further serve as a way to increase the efficient use of product from within the soft-packaging product.

Figures 2A, 2B, 2C:
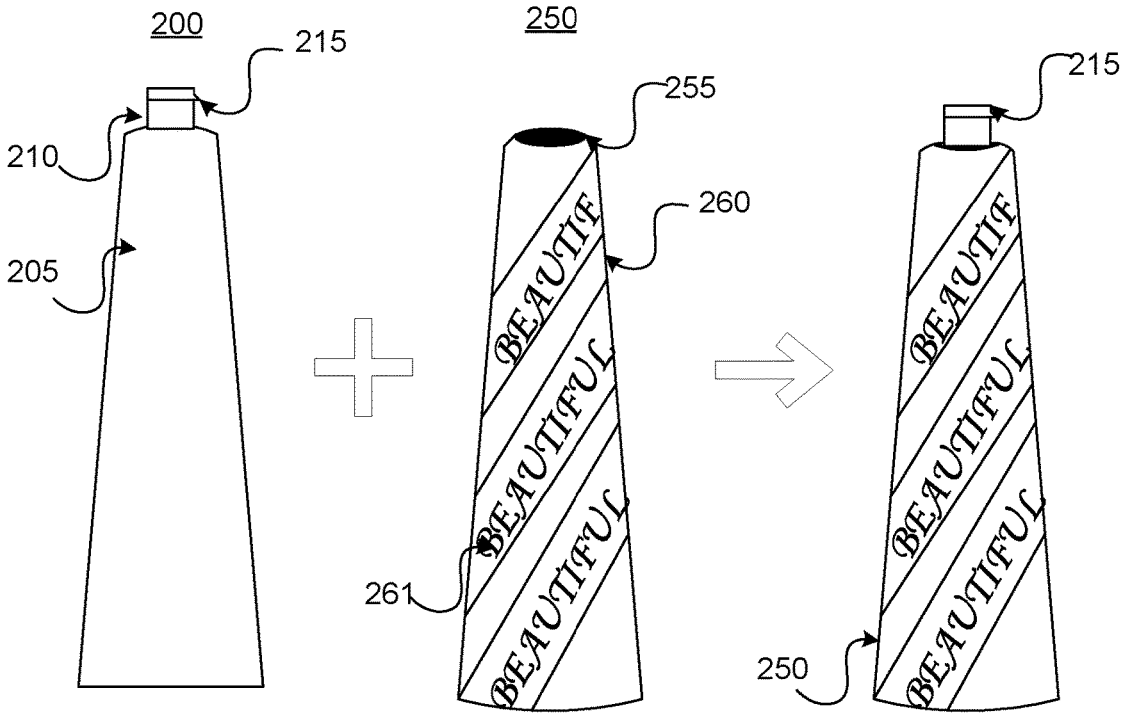
FIG. 2A illustrates an alternate exemplary soft-packaging product.
FIG. 2B illustrates an alternate exemplary decorative sleeve.
FIG. 2C illustrates an alternate exemplary embodiment of a soft-packaging product with a decorative sleeve.

Referring now to FIG. 2A, an alternate exemplary soft-packaging product 200 is illustrated. In some aspects, a soft-packaging product 200 may comprise a body 205 and a dispensing opening 210 with flip cap 215. For example, the soft-packaging product 200 may comprise a toothpaste, foot or hand cream, or sunscreen.

Referring now to FIG. 2B, an alternate exemplary decorative sleeve 250 is illustrated, wherein the decorative sleeve 250 is configured to fit over a soft-packaging product 200. In some embodiments, the decorative sleeve 250 may comprise a sheath 260 with at least one decorative feature 261 and a receiving opening 255, wherein a soft-packaging product may be inserted into the receiving opening 255.

In some aspects, the decorative feature 261 may comprise a design with text, wherein at least a portion of the sheath 260 may be opaque. In some implementations, the design may integrate with the text, such as lettering along spiraling stripes. In some embodiments, the sheath may be partially translucent, which may draw attention to the decorative feature 261.

Referring now to FIG. 2C, an alternate exemplary embodiment of a soft-packaging product with a decorative sleeve 250 is illustrated. In some aspects, the decorative sleeve 250 may extend over an edge of the body of the soft-product packaging, wherein the flip cap 215 may be exposed over the decorative sleeve 250.

Figures 3A, 3B, 3C:
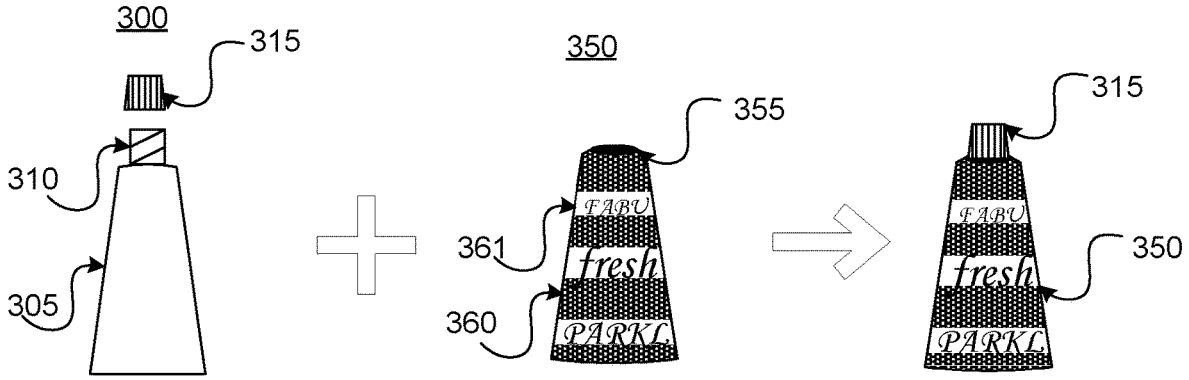
FIG. 3A illustrates an alternate exemplary soft-packaging product.
FIG. 3B illustrates an alternate exemplary decorative sleeve.
FIG. 3C illustrates an alternate exemplary embodiment of a soft-packaging product with a decorative sleeve.

Referring now to FIG. 3A, an alternate exemplary soft-packaging product 300 is illustrated. In some aspects, a soft-packaging product 300 may comprise a small body 305, a threaded dispensing opening 310, and a removable cap 315, wherein removal of the removable cap 315 may expose the threaded dispensing opening 310. For example, a soft-packaging product 300 may comprise a makeup tube, such as for eye primer, foundation, lip-gloss, or portable versions of larger products, such as sunscreen or toothpaste.

Referring now to FIG. 3B, an alternate exemplary decorative sleeve 350 is illustrated, wherein the decorative sleeve 350 is configured to fit over a soft-packaging product. In some embodiments, the decorative sleeve 350 may comprise a sheath 360 with at least one decorative feature 361 and a receiving opening 355, wherein a soft-packaging product may be inserted into the receiving opening 355.

In some embodiments, the decorative feature 361 may comprise text embossed or debossed onto the surface of the sheath 360, wherein the embossing or debossing adds a textural effect to the sheath 360. In some aspects, the textural effect may allow for a better grip or reduce slippage when a user may squeeze the soft-packaging product. For example, a textured surface may be useful where the soft-packaging product comprises an oily or slippery substance, such as first aid ointment or massaging oils. In some implementations, the textural effect or sheath material may make the soft-packaging product easier to manipulate, facilitating use for those with disabilities, arthritis, osteoporosis, or injury.

Referring now to FIG. 3C, an alternate exemplary embodiment of a soft-packaging product with a decorative sleeve 350 is illustrated. In some aspects, the decorative sleeve 350 may extend over an edge of the body of the soft-product packaging, wherein the removable cap 315 may close over the decorative sleeve 350 when screwed onto the threaded dispensing opening.

In some embodiments, the decorative sleeve 350 may provide an organizational function, wherein the decorative sleeve 350 may allow a user to quickly and easily distinguish between soft-packaging products. For example, each person in a household may share a bathroom but may use different toothpastes because of personal preference and hygienic concerns. Each person may use a unique decorative sleeve 350, wherein even if the same type of product is used, the users may distinguish between them, such as by having their name, favorite color, or personal aesthetic on the decorative sleeve 350.

As another example, a person may collect a range of soft-packaging products that may appear similar, such as makeup tubes, which may include lip-gloss, foundation, eye cream, and makeup primer. Using unique decorative sleeves for each soft-packaging product may allow for ease of distinction. In some aspects, a person may have limited vision, and a decorative sleeve 350 may allow the user to more easily find and identify the soft-packaging product.

By way of another example, someone may wish to have certain personal products readily available on their countertop but also want to have those items be private. A unique decorative sleeve 350 may indicate to that particular person or user what the product might be without indicating to a guest the contents of the decorative sleeve 350. Someone may not want a guest to know what medical products they are using, such as a particular ointment or pain medication that they have to use, due to the nature of the condition being personal or the user feeling embarrassed about their treatment.

Referring now to FIG. 4A, an exemplary embodiment of a decorative sleeve 400 is illustrated, wherein the decorative sleeve 400 comprises a flexible material. In some embodiments, a decorative sleeve 400 may comprise a sheath 415 with at least one decorative feature 410 and a receiving opening 405, wherein a soft-packaging product may be inserted into the receiving opening 405. In some aspects, the flexible material may allow a decorative sleeve 400 to be fitted to soft-packaging products within a range of predefined parameters, such as length, width, and volume. For example, the flexible material may comprise silicone, rubber, pliable plastic, flexible polymers, latex, neoprene, fabric, flexible resin, as non-limiting examples. In some aspects, the decorative sleeve 350 may comprise multiple materials. For example, the exterior may comprise a stretchable fabric, the interior may comprise a silicone, and the receiving opening may comprise a flexible material that may expand to accept the soft-packaging product.

Referring now to FIGS. 4B-4E, exemplary embodiments of soft-packaging products 420, 440, 460, 480 with a decorative sleeve 400 are illustrated, wherein the decorative sleeve comprises a flexible material. Referring to FIG. 4B, a soft-packaging product 420 may comprise a thin, long tube. In some aspects, the sheath 415 of the decorative sleeve 400 may stretch to fit the length of the soft-packaging product 420, and the receiving opening 405 may fit the width of the soft-packaging product 420 in its original shape.

Referring to FIG. 4C, a soft-packaging product 440 may comprise a wide, long tube. In some aspects, the sheath 415 of the decorative sleeve 400 may stretch to fit the length of the soft-packaging product 440, and the receiving opening 405 may stretch to fit the width of the soft-packaging product 440 in its original shape.

Referring to FIG. 4D, a soft-packaging product 460 may comprise a thin, short tube. In some aspects, the sheath 415 of the decorative sleeve 400 may extend beyond the length of the soft-packaging product 460, and the receiving opening 405 may fit the width of the soft-packaging product 460 in its original shape.

Referring to FIG. 4E, a soft-packaging product 480 may comprise a wide, short tube. In some aspects, the sheath 415 of the decorative sleeve 400 may fit the length of the soft-packaging product 480 in its original shape, and the receiving opening 405 may stretch to fit the width of the soft-packaging product 480.

Figure 5A:
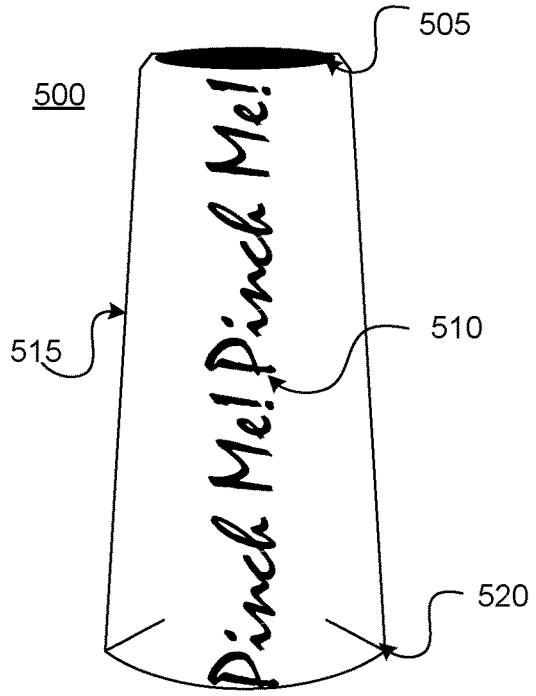
FIG. 5A illustrates an exemplary decorative sleeve, wherein the exemplary decorative sleeve comprises a metallic material.

Referring now to FIG. 5A, an exemplary embodiment of a decorative sleeve 500 is illustrated, wherein the decorative sleeve 500 comprises a metallic material. In some embodiments, a decorative sleeve 500 may comprise a sheath 515 with at least one decorative feature 510 and a receiving opening 505, wherein a soft-packaging product may be inserted into the receiving opening 505. In some aspects, a decorative sleeve 500 may comprise folding notches 520, which may allow for easy folding to fit the decorative sleeve 500 to soft-packaging products within a range of predefined parameters, such as length, width, and volume. For example, the decorative sleeve 500 may comprise aluminum, copper, steel, tin, nickel, titanium, gold, stainless steel, or other thin sheet metals. In some embodiments, the decorative sleeve 500 may comprise a mixture of materials to create a metallic material or may comprise a mixture to produce a metallic feature or appearance.

Figure 5B:
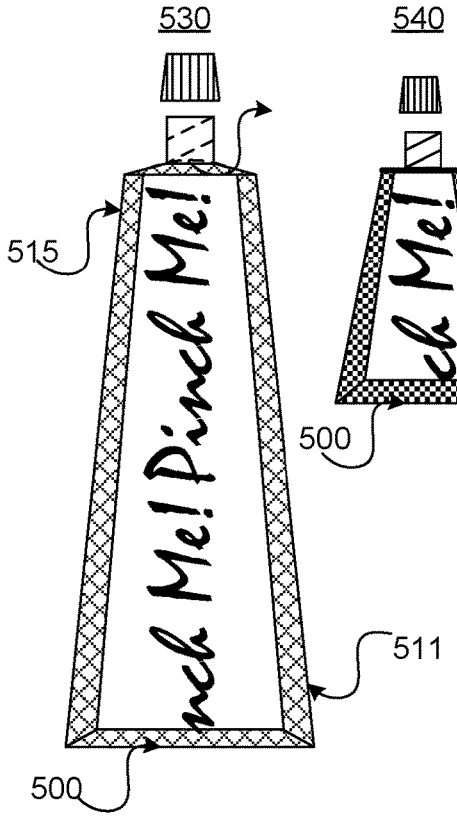
FIG. 5B illustrates an exemplary embodiment of a soft-packaging product with a decorative sleeve wherein the exemplary decorative sleeve comprises a metallic material.

Referring now to FIGS. 5B-5E, exemplary embodiments of soft-packaging products 530, 540, 550, 560 with a decorative sleeve 500 are illustrated, wherein the decorative sleeve 500 comprises a metallic material. Referring to FIG. 5B, a soft-packaging product 530 may comprise a thin, long tube. In some aspects, the sheath 515 of the decorative sleeve 500 may be folded or pinched to fit the length and width of the soft-packaging product 530, wherein the folded edges 511 may be folded twice.

Figure 5C:
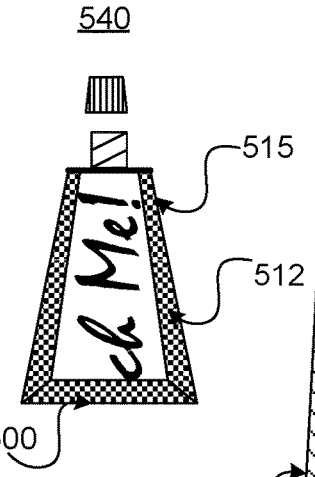
FIG. 5C illustrates an exemplary embodiment of an alternate soft-packaging product with a decorative sleeve wherein the exemplary decorative sleeve comprises a metallic material.
Figure 5D:
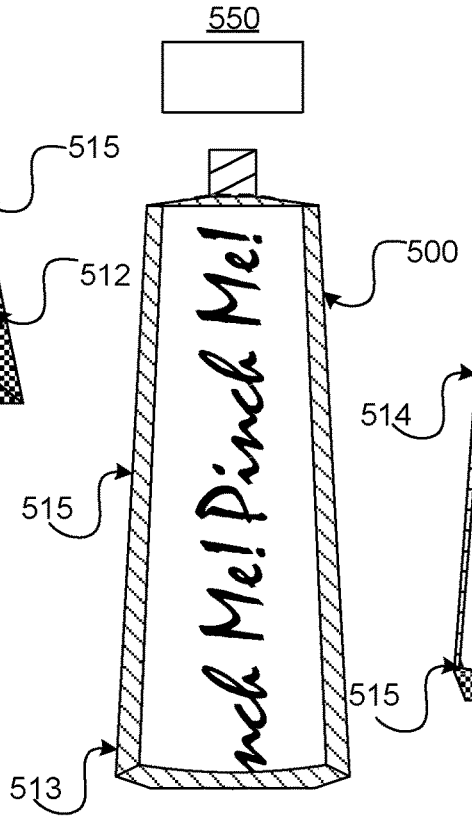
FIG. 5D illustrates an exemplary embodiment of an alternate soft-packaging product with a decorative sleeve wherein the exemplary decorative sleeve comprises a metallic material.

Referring to FIG. 5C, a soft-packaging product 540 may comprise a thin, short tube. In some aspects, the sheath 515 of the decorative sleeve 500 may be folded or pinched to fit the length and width of the soft-packaging product 540, wherein the folded edges 512 may be folded three times. Referring to FIG. 5D, a soft-packaging product 550 may comprise a wide, long tube. In some aspects, the sheath 515 of the decorative sleeve 500 may be folded or pinched to fit the length and width of the soft-packaging product 550, wherein the folded edges 513 may be folded once.

Figure 5E:
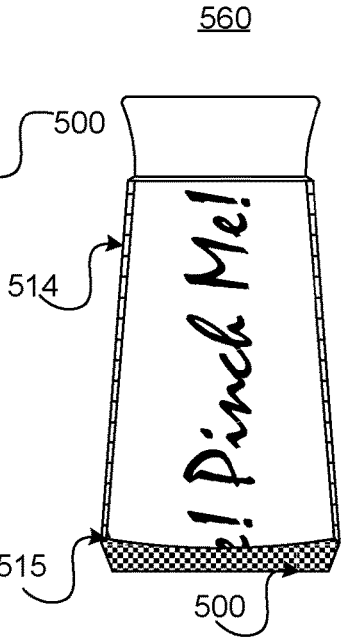
FIG. 5E illustrates an exemplary embodiment of an alternate soft-packaging product with a decorative sleeve wherein the exemplary decorative sleeve comprises a metallic material.

Referring to FIG. 5E, a soft-packaging product 560 may comprise a wide, short tube. In some aspects, the sheath 515 of the decorative sleeve 500 may be folded or pinched to fit the length and width of the soft-packaging product 560, wherein the folded edges 513 may be nominally folded on the sides and folded three times at the bottom.

Figure 6A:
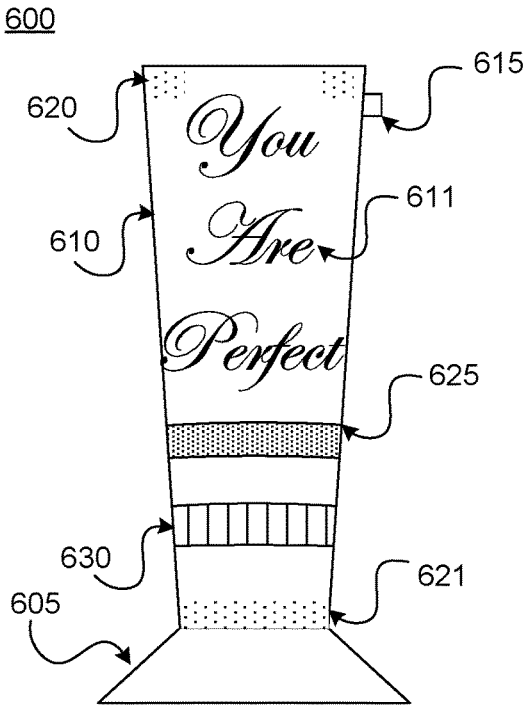
FIG. 6A illustrates an exemplary embodiment of a decorative sleeve with attached cap.

Referring now to FIG. 6A, an exemplary embodiment of a decorative sleeve 600 with attached cap 605 is illustrated. In some implementations, a variety of cap types may be substituted, including square, twist off, hinged, flip-top, or snap-on caps, as well as a pump in place of a cap, as non-limiting examples. In some aspects, the decorative sleeve 600 may comprise a sheath 610 with at least one decorative feature 611, such as horizontal text, wherein the horizontal text may be correctly oriented when the attached cap 605 is usable as a stand. In some embodiments, the sheath 610 may comprise one or more holes 620, 621, wherein the one or more holes 620, 621 may allow for breathability and drainage, which may reduce accumulation of product buildup, bacteria, mold, mildew, and water. In some aspects, the one or more holes 620, 621 may allow for the insertion of an additional decorative feature, such as beads, buttons, or charms. This may allow for individual customization of a decorative sleeve 600.

In some implementations, the decorative sleeve 600 may be washable, such as through a dishwasher, hot soap and water, or disinfectant. In some aspects, the decorative sleeve 600 may comprise a disposable lining that may be replaced without requiring a new decorative sleeve 600. In some aspects, the decorative sleeve 600 may be intended for use with a single soft-packaging product, wherein the decorative sleeve 600 may not be easily removed or may lose functionality over extended user, such as dissolving based on accumulation of bacteria. For example, a portion of the decorative sleeve 600 may comprise an adhesive, wherein the decorative sleeve 600 may stick to the soft-packaging product. In some aspects, both the decorative sleeve 600 and soft-packaging product may be disposed of together.

In some aspects, the decorative sleeve 600 may comprise a squeeze toggle 615, which may allow a user to ensure all or most of the product may be used out of the soft-packaging. In some embodiments, the decorative sleeve 600 may comprise an amount indicator 630, which may indicate a relative or actual amount of product remaining in the soft-packaging product.

In some embodiments, one or more parameter of the decorative sleeve 600 may be customized, such as decorative features 611, additional functionality, functional parameters, size, material, as non-limiting examples. In some aspects, the parameters may be customized during the ordering process, such as selection of size parameters based on selection of a soft-packaging product, brand, type; selection of decorative features 611, such as color, text, images, drawings, texture; additional functionality, such as a squeeze toggle 615; sensors; portability features, such as key chains or clips; coupling features, such as a toothbrush or makeup brush holder; organization features, such as suction cups, stability grips.

In some aspects, the decorative sleeve 600 may be manufactured from a base mold, wherein the base mold may determine or limit some parameters such as size, functionality, or material. In some embodiments, the base mold may allow for customization prior to manufacturing, such as by inserting a decorative plate or particulate that may be absorbed into the material, such as some types of glitter. In some aspects, the decorative sleeve 600 may be partially cured within the base mold and customized during the final curing steps. In some implementations, the decorative features 611 may be added after the molding process, such as through welding, printing, etching, or adhesion, as non-limiting examples.

In some embodiments, one or more parameters may be customized post-manufacturing. In some aspects, the decorative sleeve 600 may comprise a magnetic or adhesive surface, wherein a user may easily add and remove text, decorations, and color panels. In some embodiments, the decorative sleeve 600 may comprise a writable surface. In some aspects, the decorative sleeve 600 may comprise a light emitting diode screen, which may allow a user to upload images, change text, or set dynamic decorative features, which may automatically change. In some aspects, the decorative sleeve 600 may comprise a base aesthetic, such as an animal or tree, and a user may select from pieces to further customize the decorative features 611, such as with a tail, eyes, fur, stripes, ears, fins, or paws for an animal base or leaves, nests, birds, ornaments, flowers, or fruit for a tree base.

In some implementations, the decorative sleeve 600 may comprise a timing meter 625. In some aspects, the timing meter 625 may monitor time, such as to ensure a product may be used within a sanitary or optimum period of time or to remind a user to clean or replace the decorative sleeve 600. In some aspects, the decorative sleeve 600 may be set for a predefined segment of time, such as a duration of teeth brushing. For example, the timing meter 625 may comprise a sand timer. In some embodiments, the timing meter 625 may be paired with a sensor that may monitor a predefined parameter, such as bacteria, moisture, or pressure, wherein the predefined parameter may complement the purpose of the timing meter 625.

Figure 6B:
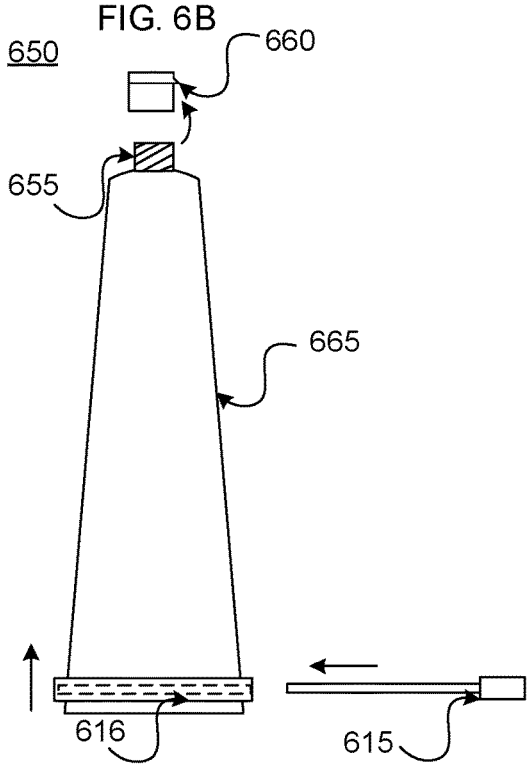
FIG. 6B illustrates an exemplary embodiment of a soft-packaging product, wherein the soft-packaging product may be adapted for a decorative sleeve.

Referring now to FIG. 6B, an exemplary embodiment of a soft-packaging product 650 is illustrated, wherein the soft-packaging product 650 may be adapted for a decorative sleeve 600. In some aspects, the soft-packaging product 650 may comprise a flip-cap top 660, a threaded dispensing opening 655, and a body 665 that may house the product. In some aspects, it may be preferable to remove the flip-cap top 660 and allow the attached cap of the decorative sleeve supplant the original mechanism. Removal of the flip-cap top 660 may limit excessive product buildup. In some embodiments, a squeeze bar 616 may be fitted through the base of the soft-packaging product 650, wherein the squeeze toggle 615 may be inserted into the squeeze bar after the soft-packaging product 650 is fitted into the decorative sleeve.

Figure 6C:
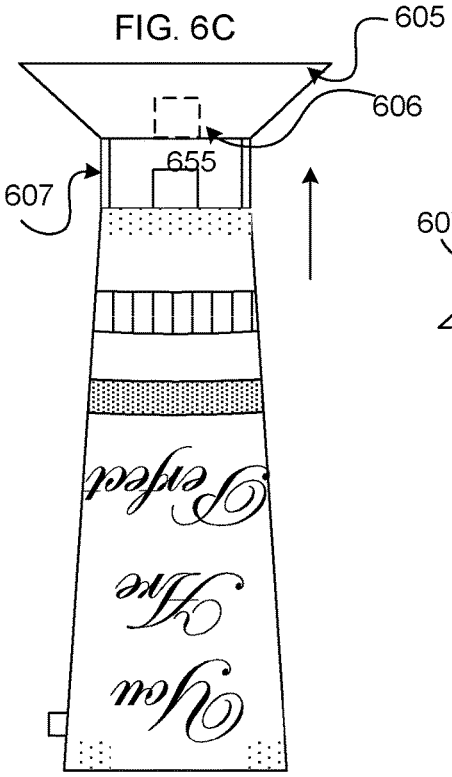
FIG. 6C illustrates an exemplary embodiment of a soft-packaging product with a decorative sleeve, wherein the attached cap of the decorative sleeve may expose the dispensing opening.

Referring now to FIG. 6C, an exemplary embodiment of a soft-packaging product with decorative sleeve 600 is illustrated, wherein the attached cap 605 of the decorative sleeve 600 may expose the dispensing opening 655. In some embodiments, the attached cap 605 may comprise a housing divot 606, which may be a similar or same shape and size as the dispensing opening 655. In some aspects, the attached cap 605 may be attached to the decorative sleeve 600 with a plurality of cap straps 607. The cap straps 607 may be flexible and elastic, wherein the cap straps 607 stabilize the attached cap 605 over the dispensing opening 655 and limit incidental removal of the attached cap 605.

Figure 6D:
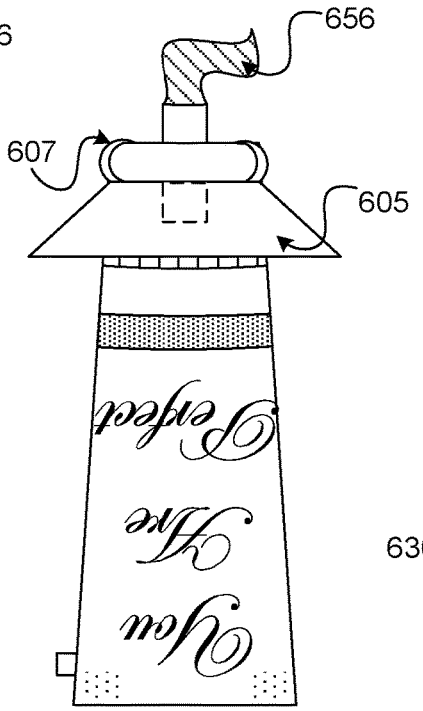
FIG. 6D illustrates an exemplary embodiment of a soft-packaging product with a decorative sleeve, wherein product may be squeezed from the soft-packaging product.

Referring now to FIG. 6D, an exemplary embodiment of a soft-packaging product with decorative sleeve 600 is illustrated, wherein product 656 may be dispensed from the soft-packaging product. In some embodiments, the cap straps 607 may hang limp with the attached cap 605, wherein the cap straps 607 prevent loss of the attached cap 605. Once used, the attached cap 605 may be replaced by stretching the cap straps 607 up and over soft-packaging product and aligning the housing divot 606 with the dispensing opening 655.

Figure 6E:
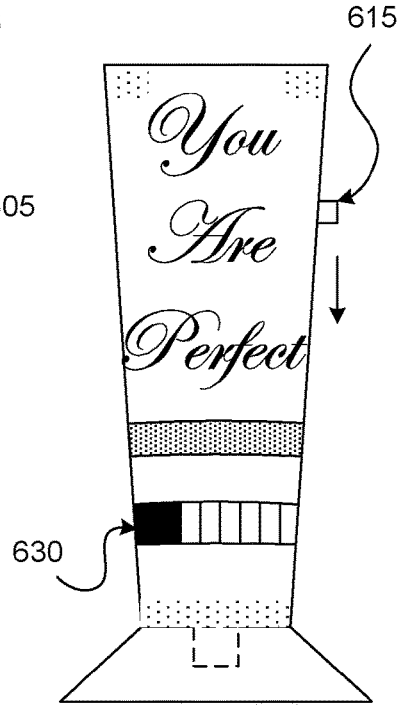
FIG. 6E illustrates an exemplary embodiment of a soft-packaging product with a decorative sleeve, wherein the amount indicator displays a change in product remaining.

Referring now to FIG. 6E, an exemplary embodiment of a soft-packaging product with decorative sleeve 600 is illustrated, wherein the amount indicator 630 displays a change in product remaining. In some aspects, the amount indicator 630 may display a reduction in product remaining, such as after use or leak. In some embodiments, the amount indicator 630 may assess the relative amount of product left based on the relative position of the squeeze toggle 615. In some embodiments, the squeeze toggle 615 may be manually manipulated, such as by sliding, clicking, or rolling the squeeze toggle 615. In some aspects, the squeeze toggle 615 may be automatic, wherein movement of the squeeze toggle 615 may occur electronically, magnetically, or mechanically.

In some aspects, the amount indicator 630 may be calibrated to a particular soft-packaging product, such as by an interactive calibration process or by calibration standards for general brands, sizes, and lines of soft-packaging products. In some implementations, the decorative sleeve 600 may comprise sensors, which may determine an amount of product remaining, such as by sensing proximity of adjacent walls of the soft-packaging product.

Referring now to FIG. 7A, an exemplary soft-packaging product 700 is illustrated. In some aspects, a soft-packaging product 700 may comprise a body 705, a threaded dispensing opening 710, and a removable cap 715, wherein removal of the removable cap 715 may expose the threaded dispensing opening 710. For example, the soft-packaging product 700 may comprise toothpaste, wound ointment, or muscle cream.

Referring now to FIG. 7B, an exemplary decorative sleeve 750 is illustrated, wherein the decorative sleeve 750 is configured to fit over a soft-packaging product. In some embodiments, the decorative sleeve 750 may comprise a sheath 760 with at least one decorative feature 761 and a receiving opening 765, wherein a soft-packaging product may be inserted into the receiving opening 765. In some aspects, the receiving opening 765 may be located along a side or on the back of the sheath 760, and the sheath 760 may further comprise a secondary opening 755, which may fit around the threaded dispensing opening 710. In some implementations, the decorative sleeve 750 may comprise one or more fitting mechanisms 770, which may secure the sheath 760 around the soft-packaging product 700.

Referring now to FIG. 7C, an exemplary soft-packaging product 700 being inserted through the receiving opening 765 of an exemplary decorative sleeve 750 is illustrated. In some aspects, the fitting mechanisms 770 may be opened allowing the soft-packaging product 700 to be inserted into the receiving opening 765. In some aspects, the fitting mechanisms 770 may comprise snaps, Velcro, magnets, zippers, adhesives, or buttons, as non-limiting examples. In some embodiments, the fitting mechanisms 770 may comprise a tab that may be tightened around the decorative sleeve 750. In some implementations, the fitting mechanisms 770 may be located along the side or inside of the receiving opening 765, which may allow for a more seamless appearance.

Referring now to FIG. 7D, an exemplary embodiment of a soft-packaging product 700 with a decorative sleeve 750 is illustrated. In some aspects, the decorative sleeve 750 may extend over an edge of the body of the soft-product packaging 700. In some embodiments, at least a portion of the decorative sleeve 750 may comprise an anti-microbial material, which may limit collection of bacteria.

CONCLUSION

A number of embodiments of the present disclosure have been described. While this specification contains many specific implementation details, these should not be construed as limitations on the scope of any disclosures or of what may be claimed, but rather as descriptions of features specific to particular embodiments of the present disclosure.

Certain features that are described in this specification in the context of separate embodiments can also be implemented in combinations or in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

Moreover, the separation of various system components in the embodiments described above should not be understood as requiring such separation in all embodiments, and it should be understood that the described components and systems can generally be integrated together in a single product or packaged into multiple products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order show, or sequential order, to achieve desirable results. In certain implementations, multitasking and parallel processing may be advantageous. Nevertheless, it will be understood that various modifications may be made without departing from the spirit and scope of the claimed disclosure.

What is claimed is:

1. A decorative sleeve for soft-packaging products comprising:

a receiving opening;

a sheath, wherein the sheath at least partially comprises a stretchable material;

a decorative feature located on the sheath; and a soft-packaging product comprising:

a body, a dispensing opening, a product cap configured to at least partially cover the dispensing opening, wherein the product cap is configured to be removably received by the dispensing opening; and a product;

wherein the receiving opening is located at a first end of the sheath, wherein a second end of the sheath opposite to the first end remains closed, wherein the receiving opening stretches to allow the soft-packaging product to be inserted into and removed from the sheath, wherein the sheath is configured to completely obscure the body of the soft-packaging product when the body of the soft-packaging product is fully inserted into the sheath, wherein the dispensing opening at least partially protrudes through the receiving opening such that the dispensing opening is able to receive the product cap when the body of the soft-packaging product is fully inserted within the sheath, and wherein the body of the soft-packaging product changes shape as an amount of the product enclosed within the body changes.

2. The decorative sleeve for soft-packaging products of claim 1, wherein at least a portion of the decorative feature comprises color.

3. The decorative sleeve for soft-packaging products of claim 1, wherein the decorative feature is integrated into a material of the sheath.

4. The decorative sleeve for soft-packaging products of claim 1, wherein the sheath comprises an anti-microbial material.

5. The decorative sleeve for soft-packaging products of claim 1, further comprising at least one connector and a sheath cap, wherein the sheath cap is configured to at least partially cover the receiving opening, wherein the sheath cap is attached to the at least one connector and the at least one connector is attached to the first end, and wherein the sheath cap remains attached to the at least one connector and the at least one connector remains attached to the first end when the sheath cap does not at least partially cover the receiving opening.

6. The decorative sleeve for soft-packaging products of claim 1, wherein the sheath comprises a textured surface.

7. The decorative sleeve for soft-packaging products of claim 6, wherein the decorative feature creates the textured surface.

8. The decorative sleeve for soft-packaging products of claim 1, wherein the sheath comprises a metallic material.

9. The decorative sleeve for soft-packaging products of claim 8, wherein the sheath comprises a plurality of foldable edges.

10. The decorative sleeve for soft-packaging products of claim 1, wherein the decorative sleeve comprises a washable material.

11. The decorative sleeve for soft-packaging products of claim 10, wherein the sheath comprises a silicone, wherein the silicone maintains a shape of the sheath.

12. The decorative sleeve for soft-packaging products of claim 1, further comprising a squeeze toggle configured to fit over the body, wherein the squeeze toggle is configured to allow a user to efficiently dispense the product.

13. The decorative sleeve for soft-packaging products of claim 12, wherein the squeeze toggle extends through a portion of the sheath.

* * * * *